US007306316B2

(12) United States Patent
Doak

(10) Patent No.: US 7,306,316 B2
(45) Date of Patent: Dec. 11, 2007

(54) NANOSCALE INK-JET PRINTING

(75) Inventor: R. Bruce Doak, Tempe, AZ (US)

(73) Assignee: Arizona Board of Regents, Tempe, AZ (US)

( * ) Notice: Subject to any disclaimer, the term of this patent is extended or adjusted under 35 U.S.C. 154(b) by 338 days.

(21) Appl. No.: 10/513,433

(22) PCT Filed: May 28, 2003

(86) PCT No.: PCT/US03/16405

§ 371 (c)(1),
(2), (4) Date: May 19, 2005

(87) PCT Pub. No.: WO03/101736

PCT Pub. Date: Dec. 11, 2003

(65) Prior Publication Data

US 2005/0200648 A1 Sep. 15, 2005

Related U.S. Application Data

(60) Provisional application No. 60/384,602, filed on May 29, 2002.

(51) Int. Cl.
*B41J 2/015* (2006.01)

(52) U.S. Cl. ..... 347/21; 347/20

(58) Field of Classification Search ..... 347/20, 347/21, 47, 68, 74–77
See application file for complete search history.

(56) References Cited

OTHER PUBLICATIONS

Braun et al. "Micrometer-sized Nozzles and Skimmers for the Production of Supersonic He Atom Beams", Rev. Sci. Instrum. vol. 68, No. 8, Aug. 1997, pp. 3001-3009.
Jetlab® "Printing Platform", MicroFab Technologies, Inc., Rev. 01-01-02, 2002, 7 pgs.

*Primary Examiner*—Shih-Wen Hsieh
(74) *Attorney, Agent, or Firm*—Christie, Parker & Hale LLP

(57) ABSTRACT

A non-direct contact ink-jet style printer is disclosed herein, which uses a superfluid cryogenic fluid such as superfluid helium as the ink medium. Superfluid helium is non-viscous thus enabling the print head of the present invention to print nanoscale characters onto a substrate. In one exemplary embodiment, dopants are injected into the ink droplets to load the droplets with dopants, which then deliver the dopants onto the substrate. Multiple nozzles and different dopants may be used with the embodiments disclosed herein to provide different outputs on the substrate. Spent or un-used droplets and dopants may be educted away and discarded or scrubbed for reuse. Methods for printing using superfluid helium are also discussed herein.

39 Claims, 2 Drawing Sheets

NANOSCALE INK-JET PRINTING

CROSS-REFERENCE TO RELATED APPLICATION

This application claims the benefit of provisional application Ser. No. 60/384,602, filed May 29, 2002, entitled NANOSCALE INK-JET PRINTING BY USE OF SUPERFLUID LIQUID HELIUM JETS, the content of which is expressly incorporated herein by reference.

Nanoscale printing is generally discussed herein with particular discussion on nanoscale printing using a cryogenic source as the medium to deposit a dopant onto a substrate.

BACKGROUND

Existing methods for liquid deposition are either limited to micron-scale resolution or larger or are slow and cumbersome direct-contact techniques. One exemplary liquid deposition method includes ink-jet printing. Ink-jet printing is an accurate, high-throughput, non-contact technique that has been used with a wide variety of fluids ranging from printer ink to electrical solder to polymers to biologically active molecules. Since ink-jet printing is intrinsically droplet-based, it is very well suited to digital control and thereby to mask-free deposition. Being a non-contact technique, ink jet deposition is inherently contamination-free. However, due to basic physical limitations, existing ink-jet printing is limited to feature sizes of about 15 μm or larger. Therefore, nanoscale printing, in the order of 1 to 999 nanometers, using existing ink-jet technology is not possible at least without sacrificing throughput.

Alternative writing techniques have emerged for depositing liquids at linewidths down to about 100 nm. Principle among these is the "dip-pen" technique of Mirkin and co-workers, which developed the concept based on fluid flow through the meniscus formed when a fluid-coated atomic force microscope (AFM) tip is brought into contact with (or near proximity to) a solid surface. However, dip-pen writing is inherently slow.

Dip-pen technique is capable of printing arrays as arrays of AFM tips can be fabricated. However, the tip spacing is dictated by the width and length of the AFM cantilevers, which typically is in the order of about 50 μm tip-to-tip spacing between cantilevers of 300 μm length. These dimensions define the minimum grid size of the writing array, meaning that each tip must still cover an area of at least 50 μm×300 μm. Moreover, there is significant overhead time required to reload the liquid coating on each tip when the "ink" is exhausted.

The dip-pen community is now attempting to incorporate ink reservoirs and microfluidic flow channels into the dip-pen microstructures in order to continually supply fluid to each tip. Whether these efforts will be successful remains to be seen. In all events, dip-pen direct writing is a cumbersome approach in comparison to ink-jet printing. However, it does offer nanoscale resolution, which current ink-jet deposition does not.

Another printing technology is photolithographic process. Broadly speaking, it is a process by which an image is transferred from a mask to a wafer through the use of a photosensitive material often called photoresist. Through light-activated chemical reaction, a photoresist is either process hardened or process softened. The process also involves etching and baking to achieve the desired outcome. However, because etching and baking are involved, the process is generally not appropriate for depositing biologically active materials, such as DNA, diagnostic immunoassay, antibody and protein arrays.

Accordingly, there is a need for nanoscale printing capable of high rate and accuracy without the drawbacks of prior art printers. A high throughput, non-contact, nanoscale printing technology would improve existing fabrication technology by decreasing device structure sizes into the nanoscale regime. In addition, a discrete droplet nanoscale printing technique would allow the use of single molecules as fundamental building blocks for fabrication, including both complex and/or biologically active molecules. Exemplary areas of technological relevance include the deposition of biomolecules (e.g., proteins, peptides, DNA) in nanoarrays for biological sensor applications and the patterned deposition of complex molecular species to form electronic and mechanical devices based on single molecules and/or on nanostructures of molecules.

SUMMARY

The present invention specifically addresses and alleviates the above-mentioned deficiencies associated with the prior art assemblies. More particularly, the present invention may be implemented by using a jet apparatus for nanoscale printing onto a substrate comprising a print head and a translational apparatus housed in a housing comprising at least one housing chamber; a reservoir comprising a cryogenic fluid in communication with the print head; and a dopant injector mechanically coupled to a storage containment comprising dopant molecules; and wherein at least one droplet of the cryogenic fluid is discharged from the print head and is expelled across at least a part of the housing chamber to combine with at least one dopant molecule discharged from the dopant injector, and wherein the combined at least one droplet of the cryogenic fluid and the at least one dopant molecule collides with the substrate positioned on the translational apparatus.

In another aspect of the present invention, a printer capable of non-contacting nanoscale printing is disclosed comprising a nozzle having a nanoscale diameter orifice, a cryostat comprising a chamber comprising superfluid helium in fluid communication with the print head, a housing comprising at least one chamber comprising dopant molecules; and a translational apparatus comprising a substrate; wherein the superfluid helium issuing from the nozzle of the print head breaks up into nanoscale droplets; and wherein one or more nanoscale droplets of superfluid helium each picks up at least one dopant molecule and delivers the at least one dopant molecule into contact with the substrate.

In still yet another aspect of the present invention, a method is disclosed for non-contact printing onto a substrate comprising the steps of issuing a stream of superfluid helium from a nozzle along a path and allowing the stream to form into a plurality of nanoscale helium droplets; placing dopants in the path of the plurality of nanoscale helium droplets and allowing at least some of the droplets to pick up some of the dopants placed in the path of the droplets; and depositing the picked up dopants by allowing the at least some of the droplets that picked up the dopants to collide with the substrate.

The present invention may also be implemented by incorporating a jet apparatus for nanoscale printing onto a substrate comprising a housing comprising a nozzle having a nanoscale orifice, a chamber under a vacuum, a translational apparatus comprising a substrate, and a cryostat comprising a cryogenic source, wherein at least some of the cryogenic source issues from the nozzle and disperses into nanoscale droplets in the chamber, wherein at least some of the nanoscale droplets each comprises at least one dopant molecule picked up in the cryostat or picked up in the chamber, and wherein the picked up nanoscale droplets impact with the substrate, Other aspects and variations of the apparatus and method summarized above for nanoscale printing are also contemplated and will be more fully understood when considered with respect to the following disclosure.

BRIEF DESCRIPTION OF THE DRAWINGS

These and other features, aspects and advantages of the present invention will be more fully understood when considered with respect to the following detailed description, appended claims and accompanying drawings, wherein:

DETAILED DESCRIPTION

Figure 1:
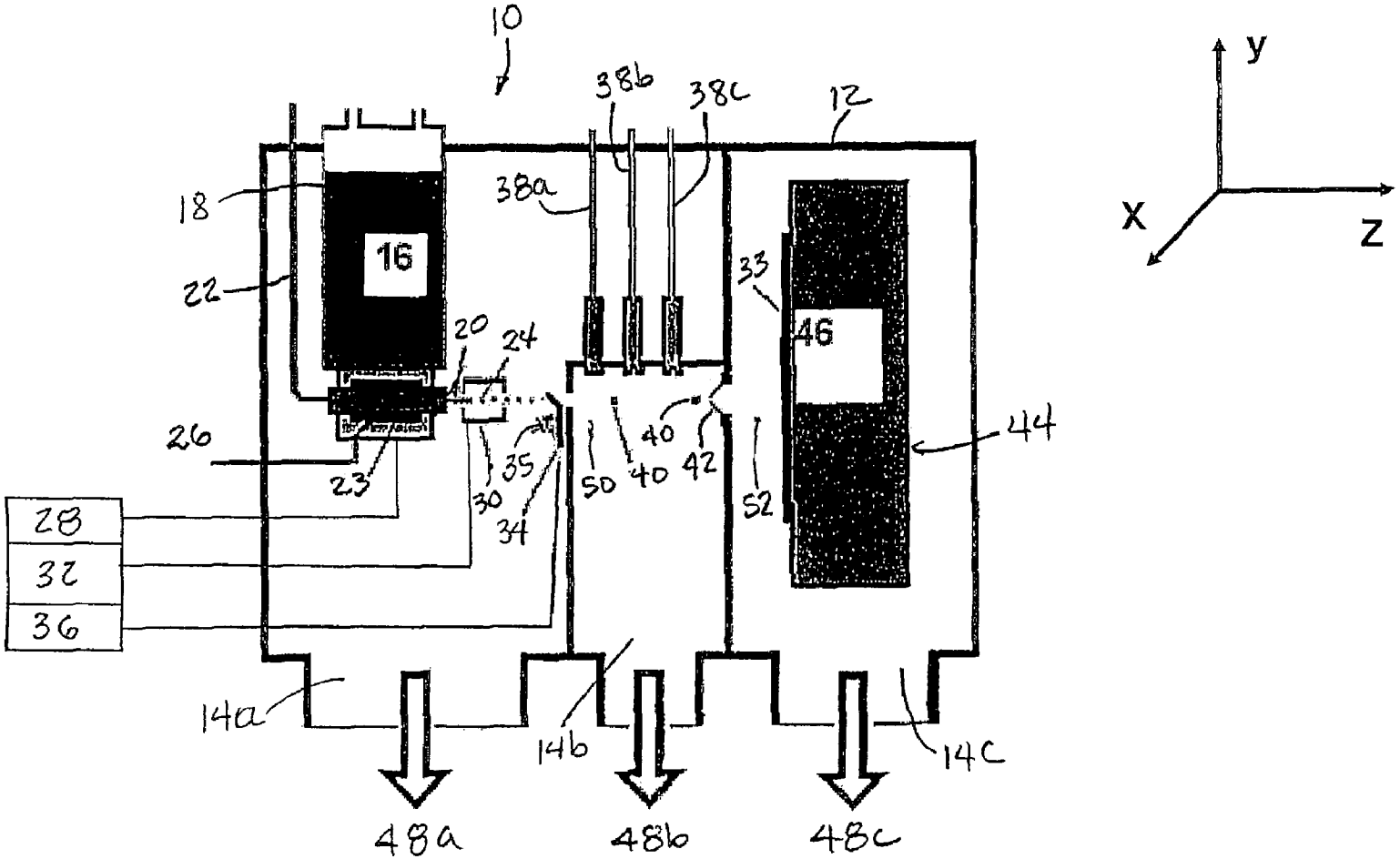
FIG. 1 is a semi-schematic component diagram depicting a continuous mode superfluid liquid helium jet apparatus for nanoscale ink-jet deposition provided in accordance with one aspect of the present invention.

The detailed description set forth below in connection with the appended drawings is intended as a description of the presently preferred nanoscale printing embodiments provided in accordance with practice of the present invention and is not intended to represent the only forms in which the present invention may be constructed or utilized. The description sets forth the features and the steps for constructing and using nanoscale ink-jet printing of the present invention in connection with the illustrated embodiments. It is to be understood, however, that the same or equivalent functions and structures may be accomplished by different embodiments that are also intended to be encompassed within the spirit and scope of the invention. Also, as denoted elsewhere herein, like element numbers are intended to indicate like or similar elements or features.

The spatial resolution of ink-jet deposition is ultimately fixed by the size of the nozzle through which the liquid stream emerges. The minimum size of the nozzle is set by the volumetric flow rate of the liquid through the nozzle and thereby by the cross sectional area of the nozzle and viscosity of the liquid. Considering the case of simple Poiseuille flow (viscous fluid flow through a long straight tube of circular cross section), the volumetric flux Q is $$Q = \frac{\pi a^4 \Delta p}{8\,\mu l}, \tag{1}$$

where a is the radius of the tube, I the length of the tube, Δp the pressure difference between the ends of the tube, and μ the viscosity of the fluid. Accordingly, the volumetric flux decreases dramatically as the radius of the nozzle is decreased and increases as the viscosity of the fluid is decreased.

Conventional ink-jet printing can dispense droplets of diameter ranging from 15 to 200 μm (2 pl to 5 nl droplet volume) at rates of up to 25,000 droplets/s for pulsed (on demand) operation or up to 1 million droplets/s for continuous flow operation. This droplet size range provides more than adequate spatial resolution for printing purposes and even suffices for some microfabrication applications such as DNA deposition, chemical synthesis, biopolymer and solid support applications, chemical analysis, and microassembly of electronic or photonic material.

However, when viscous materials are deposited or when higher throughput is desired, prior art ink-jet printing technology suffers from at least several shortcomings. Among other things, for a given viscosity, generating significantly smaller droplets (i.e., by decrease in nozzle size) for higher spatial resolution is not feasible without sacrificing throughput. With reference to equation (1), the throughput of a 20 nm diameter nozzle, for example, would be a factor of $10^{12}$ less than that of a 20 μm nozzle of the same length and at the same pressure drop.

Thus, by employing superfluid liquid helium as the "ink" medium, the throughput limitation of equation (1) is removed due to the fact that superfluid helium, by its nature, has zero viscosity. This characteristic is well documented: Helium in the superfluid state is a second liquid phase of Helium that appears at low temperatures below the liquid-solid transition pressure. Helium is the only material known to display superfluid behavior and the phenomenon is exhibited by both stable isotopes of helium, $^4$He below approximately 2.2° K, and $^3$He below approximately 0.0025° K $^4$He is the much more abundant and inexpensive isotope. These properties, along with its higher superfluid transition temperature, make $^4$He the preferred species for the various ink-jet uses described in this application. However, superfluid $^3$He would be entirely suitable at very low temperature for use with the embodiments provided in accordance with aspects of the present invention.

With zero viscosity, equation (1) would predict an infinite throughput. This, however, is disallowed by conservation of energy, since infinite throughput of a fluid of finite mass would correspond to infinite kinetic energy. Therefore, conservation of energy becomes the controlling physical law, in the form of Bernoulli's Law. The flow velocity v for a superfluid in horizontal flow then depends only on the density and the pressure difference, specifically $$v = \sqrt{\frac{2\Delta p}{\rho}}, \tag{2}$$

where ρ is the mass density of the fluid. At pressure gradients of near one atmosphere, equation (2) predicts flow velocities of a few tens of meters per second for superfluid helium. The corresponding volumetric flow rate through a circular channel of radius a is given by the equation $$Q = \pi a^2 \sqrt{\frac{2\Delta p}{\rho}}$$

in which there is no dependence on the viscosity μ and in which the dependence on the channel radius a is only quadratic (rather than quartic, as for Poiseuille flow). Hence, by utilizing superfluid helium as the ink medium for ink-jet printing, print speed is much less diminished when attempting higher resolution printing since viscosity is no longer a factor and since throughput decreases much less rapidly with decreasing channel radius.

Turning now to FIG. 1, a semi-schematic component diagram depicting a continuous mode superfluid liquid helium jet apparatus (herein "jet apparatus") for nanoscale ink-jet deposition provided in accordance with aspects of the present invention is shown, which is generally designated 10. The jet apparatus 10 is capable of nanoscale printing droplet sizes of about 1 nm to about 999 nm. However, by selecting a larger orifice size, as further discussed below, the jet apparatus 10 may also print larger droplet sizes. In one exemplary embodiment, the jet apparatus 10 comprises a system having a housing 12, one or more chambers or compartments 14*a*, 14*b*, 14*c*, and components for propelling the helium, for controlling the helium, for optionally mixing or loading the helium, for depositing the helium onto a substrate, and for maintaining high vacuum as further discussed below.

In one exemplary embodiment, a cryostat 16 is incorporated and cooled to below the $^4$He superfluid transition temperature by the well-documented technique of pumping on an enclosed volume of liquid $^4$He. A wide variety of commercial bath cryostats is available for this purpose. Typically the cryostat 16 incorporates a liquid nitrogen cooled shroud (not shown) that encloses and thermally shields all helium-cooled portions of the cryostat. Situated within the nitrogen-cooled shroud in direct thermal contact with the helium-cooled portion of the cryostat is a vessel 23, which is therefore at essentially the same temperature as the cryostat helium bath. This vessel 23 incorporates a nozzle 20 at one end thereof through which the $^4$He ink-jet issues. Filtered ultra-pure gaseous $^4$He is delivered to the vessel 23 through a separate supply line 22 at a chosen delivery pressure. In one exemplary embodiment, filtration may be incorporated into the nozzle vessel 23 itself. Appropriate pressure regulation may be employed to set and regulate the pressure of the $^4$He gas at a chosen pressure from about 0 atm up to about 25 atm. This gaseous helium condenses into a superfluid liquid as it passes through the vessel 23.

By virtue of its zero viscosity, the superfluid component of the liquid within the vessel 23 then issues from the nozzle 20 and into the surrounding chamber 14*a* as a cylindrical superfluid liquid free-jet. To ensure that cryogenically-cooled components of this free-jet do not heat excessively, to prevent condensation of ambient gases onto the cryogenic surfaces, and to allow unobstructed passage of the superfluid free-jet, the housing 12 and the various chambers within the housing are held in a vacuum environment, typically $10^{-8}$ atm or less but ranging up to $10^{-3}$ atm or higher in certain applications. Apart from the cryostat section that houses the superfluid helium ink-jet nozzle, all components of the apparatus 10 may be kept at or near room temperature with fluctuations being acceptable.

In one exemplary embodiment, the nozzle 20 may be fabricated in a variety of ways to produce an aperture ranging from 1 nanometer up to several hundred thousand nanometers in diameter. Exemplary fabrication methods include the ion milling of holes through thin plates and the pulling of glass or quartz capillary tubes using commercially available apparatus. Small apertures in plates and microcapillary nozzles are both commercially available. Although not deemed necessary for the understanding of the present invention, additional information may be found in the Rev. Sci. Instrum. 68, 3001-3009 (1997) publication under the article entitled "Micrometer-sized nozzles and skimmers for the production of supersonic He atom beams," authored by J. Braun, P. K. Day, J. P. Toennies, G. Witte, and E. Neher, the content of which is expressly incorporated herein by reference, The cylindrical superfluid jet issuing from the nozzle orifice has approximately the same diameter as the orifice itself. The orifice diameter therefore determines the size of the free-jet superfluid beam.

Because of a phenomenon known as Rayleigh instability, the cylindrical fluid beam of helium issuing from the nozzle 20 breaks up into monodispersed droplets 24. To narrow the droplet size distribution and to phase lock droplet formation to a fixed frequency, a disturbance frequency (which may either be a single fixed frequency to produce a set droplet size or a variable frequency to fine-tune the droplet size) may be imparted to the fluid at the nozzle 20 to create pressure, temperature, or entropy oscillations in the superfluid stream. The nozzle 20 is an equivalent of a print head in an ink-jet printer and in certain embodiments may comprise a plurality of nozzles 20.

In one exemplary embodiment, an electromechanical device, also referred to as a Rayleigh instability driver, which may include a piezoelectric transducer or a speaker 26 and associated electronic control unit 28, is used to impart pressure, temperature, and entropy oscillations to the nozzle 20. When implemented, an electronic control unit 28 supplies a periodic voltage to drive the transducer device 26 at a desired frequency. In this manner the production of droplets is phase-locked to the electronic drive signal of the electronic control unit. The electromechanical device 26 and its associated control unit 28 may be one of several commercially available instability drivers controlled by a system control computer (not shown) to regulate the size and amount of droplets 24 issuing from the nozzle 20.

A charging apparatus 30 controlled by a charge driver 32 comprising one or more electrodes for imparting electric charges to the droplets 24 may be incorporated in the jet apparatus 10 of the present embodiment. When implemented, the charging apparatus 30 imparts an electric charge to issuing droplets 24 so that the charged droplets 24 may be manipulated downstream in a deflection field (not shown). The deflection field operates by creating a charged field to either attract or repel a charged droplet 24 as the droplet passes through the field to produce a desired droplet deflection. For example, the deflection field can deflect a charged droplet to an overflow chamber for recycling the droplet or can allow the droplet to continue its path towards the deposition chamber 14*c*. In one exemplary embodiment, the charge driver 32 and the deflection field receive character data input for a desired droplet deposition, which then carry out the function by either allowing the charged droplets 24 to travel to the third chamber 14*c* for depositing onto a substrate or to an overflow chamber for recycling. This deflection scheme is conventional in the microscale ink-jet technology.

In one exemplary embodiment, a deflector 34 made by MEMS (micro-electro-mechanical systems) micro fabrication techniques may be incorporated inline with the issuing droplets 24 to vary the frequency or cycle of droplets 24 that deposit onto a substrate 33. The deflector 34 may be used instead of or in addition to the combination charging apparatus 30 and deflection field discussed above. For example, the droplets 24 may issue from the nozzle 20 at a rate of 100,000 drops per second and the deflector 34 is used to obstruct the path of the droplets to vary the number of drops that travel to the second chamber 14*b* and then to the third chamber 14*c* to anywhere from between 0 to 100,000 drops per second. The deflector 34 may be tied to a deflection driver 36 for controlling the rate of deflection of the issued droplets. Deflected droplets 35 deflected by the deflector 34 may be educted away, scrubbed or filtered, and then recycled back into the ink supply reservoir 16 for reuse.

In one exemplary embodiment, after the droplets 24 travel pass the first chamber 14*a*, they enter the second chamber 14*b* (herein alternatively referred to as "pickup chamber").

The second chamber 14*b* is also maintained in a vacuum or near vacuum condition similar to the first chamber 14*a*. The second chamber 14*b* may include one or more dopant-jet injectors (three shown) 38*a*, 38*b*, 38*c* with each jet assembly connected to a sample source (not shown) containing liquids (herein "dopants") to be deposited with nanoscale resolution onto the substrate 33. In exemplary embodiments, these dopant liquids might be bioactive molecules, biomedical reagents, DNA samples, polymers, antibodies, proteins, genes, viruses or the like. The dopant-jet injectors 38*a*, 38*b*, 38*c* are configured to controllably release the dopants via injector driver control electronics (not shown) for injection into the second chamber 14*b*. Once deposited in the second chamber 14*b*, the individual dopant atoms/molecules collide with and are incorporated into the superfluid $^4$He droplets 24. The helium droplets with the entrained dopant atoms/molecules 40 then travel to the deposition chamber or third chamber 14*c* for deposition onto the substrate 33. In one exemplary embodiment, the dopant-jet injectors 38*a*, 38*b*, 38*c* may comprise a nozzle, a combination of a nozzle and a valve, an eductor and controller, or other conventional means for discharging a stream of gas or fluid.

In an alternative embodiment, dopant atoms or molecules are mixed into the helium gas before it enters the source vessel 23 through the supply tube 22. This gas mixture condenses into a liquid mixture as it passes through the source vessel to issue from the nozzle as a superfluid stream with the dopant species already entrained. Break-up of the liquid free-jet into droplets proceeds due to Rayleigh instability as in the case of pure helium, leading to dopant containing droplets as in that case. Since the presence of dopants within the source vessel 23 can easily lead to blockage of a nanoscale nozzle aperture, this embodiment should be limited to dopant species that neither coagulate within the liquid mixture nor attach to the wall of the of the nozzle vessel at superfluid temperatures.

The dopant-jet injectors 38*a*, 38*b*, 38*c* may be synchronized with the superfluid beam or droplets 24 to deliver a pulse of gas at some desired amount and frequency. In one exemplary embodiment, the synchronization is accomplished by phase-locking the dopant-jet injectors to droplet production controlled by the electromechanical device 26 and electronic control unit 28 discussed above. Preferably, the dopant-jet injectors are aimed in the direction of the superfluid beam path and are configured to discharge at some predetermined sequence or pattern at the moment that the droplets pass through the second chamber 14*c*. If a charging apparatus 30 and a deflection field are used instead of the deflector 34, then a continuous steam of droplets 24 will pass through to the second chamber 14*b*. In such configuration, the dopant-jet injectors 38*a*, 38*b*, 38*c*, should be synchronized to only generate a pulse of gas dopants for a droplet destined for the third chamber 14*c*. Commercial pulsed molecular beam nozzles may be used to inject the dopant species into the pickup chamber 14*b*. Each pulsed nozzle or dopant-jet injector is preferably supplied with a particular dopant atom/molecule, either as a pure gas or as a dilute mixture of the dopant species in an inert carrier gas. A wide variety of techniques is available for non-destructively volatilizing and injecting atomic and molecular species through pulsed molecular beam nozzles, including complex molecular species, bioactive species, species of high molecular mass and species of low vapor pressure.

In an alternative exemplary embodiment, only one species of dopant is utilized with the jet apparatus 10 for deposition onto a substrate. The single dopant species is preferably volatile at room temperature or can be made so by mild heating of an enclosed vessel containing the dopant. By allowing the dopant gas to flow slowly into the pick-up chamber 14*b* through appropriate interconnecting tubing and through a rate-controlling aperture or valve, a steady-state low background density of the dopant species can be maintained within the pick-up chamber. The superfluid helium droplets 24 in passing through the pickup chamber 14*b* will collide with and capture the dopant atoms/molecules directly from the ambient background gas, thus eliminating the need for dopant injector nozzles. The background gas pressure of the dopant species is adjusted by choice of the rate controlling valve or aperture through which it enters the pick-up chamber, thus allowing a desired number of the dopant atoms/molecules to be picked up by each superfluid droplet in its passage through the pickup chamber.

A helium droplet 24 passing through the pickup chamber 14*b* has a finite probability of colliding with a dopant atom/molecule or atoms/molecules released by one or more of the dopant-jet injectors 38*a*, 38*b*, 38*c*. Collision of a helium droplet with a dopant molecule results in the capture of and incorporation of the dopant species into the superfluid helium droplet A helium droplet with one or more entrained dopant species is also referred to herein as a loaded droplet. The probability of collision scales directly with the density of dopant atoms/molecules along the path of the helium droplet stream. Consequently, the average number of dopant collisions experienced by a superfluid droplet in its transit through the pickup chamber 14*b*, and therefore the number of dopant atoms/molecules it captures during this transit, can be controlled by adjusting the density of the injected molecules along the axis of the droplet beam. Studies have confirmed that superfluid helium droplets may be loaded in this fashion with a wide variety of dopant species including as specific molecule samples $SF_6$, OCS, and $C_2H_2O_2$. In addition, studies have shown that foreign molecules will either aggregate at the center of the helium droplets or will decorate the droplets' exterior surface depending on the molecule-helium interaction. Molecules that aggregate at the center of the droplets are preferred, although dopant species exhibiting external decoration are also usable with the present embodiment.

The directed stream of superfluid droplets, loaded with dopant atoms/molecules 40, exits the pickup chamber 14*b* through a small diameter collimating aperture 42. If this collimator has the shape of a truncated cone with a sharp leading edge, it is also referred to as a "skimmer." A skimmer of micro- or nano-sized aperture is referred to as a microskimmer or nanoskimmer, respectively. This prescribed shape of the skimmer leads to improved transmission of the helium beam through the collimating aperture, although in many instances a collimating aperture having the form of a simple aperture in a flat plate may also suffice. Skimmers of the prescribed form may be fabricated by the same techniques described above for forming nanoscale nozzles from microcapillary tubing.

One purpose of the skimmer or collimator is to minimize effusion of dopant atoms from the pickup chamber 14*b* into the deposition chamber 14*c*. The highly directed stream of superfluid helium droplets 40 passes unhindered through the collimator orifice. In contrast to this directed stream of dopant-loaded He droplets 40, any effusing molecules from the residual gas in the pickup chamber will arrive at the collimator 42 opening from all angles. Given the micro or nanoscale diameter of the collimator 42 orifice, the flow of these residual gas species through the collimator orifice will be distributed over a range of angles and will therefore have a very low intensity at the deposition surface in the next chamber, 14*c*. As a result, the collimator 42 essentially eliminates the flux of background atoms/molecules that travel from the pickup chamber 14*c* into the deposition chamber 14*b*.

Momentum is conserved in the collision of a droplet with a dopant atom or molecule. Consequently, the direction and speed of the droplet changes slightly in the course of each collision. If this deflection is known, as is the case when both the droplet and the dopant are traveling at a known speed and in a known direction prior to the collision, the resulting deflection can be employed to precisely select loaded helium droplets according to the number of dopant molecules contained within each. In this instance the collimator 42 is mounted such that its spatial position can be varied in situ, allowing its position to be varied such that only loaded droplets with a specified number of dopant atoms or molecules pass from the pick-up chamber 14*b* into the deposition chamber 14*c*.

A translational assembly 44 comprising a print platform 46 for mounting the substrate 33 is positioned in the deposition chamber 14*c*. In one exemplary embodiment, the print platform 46, which may be a plate, a roller, or a rotating platform, is configured to translate in the X-Y-Z directions by a plurality of stepper motors or DC motors (not shown), similar to stepper motors and DC motors used with existing ink-jet printers. The rotating platform, if employed, may embody a tape chart or strip chart. Alternatively, if ink depth or deposition depth is not desired, the print platform 46 may be supported and translated along the X-Y directions only. The translational assembly 44 allows patterns or characters to be printed onto the substrate 33 by moving the substrate relative to the nozzle 20 so that the point of impact of the pickup droplets 40 onto the substrate varies to create a desired pattern or image. Three dimensional depositions may be found in tissue engineering where, for example, biosorbable polymers are printed to form scaffolds in the desired tissue shape.

When a pickup droplet 40 with foreign molecules aggregated at the center of the helium droplets impacts the substrate 33, the helium sheath surrounding the aggregated molecules provides an intrinsic impact cushion so that the molecules experience a slow and controlled deceleration as they impact the surface 33. This is also referred to as a "soft landing." By controlling the helium droplet size, more or less cushion may be provided for the impacting molecules. In one exemplary embodiment, the helium droplet size may be controlled by varying or controlling the orifice size of the nozzle 20. The helium droplet should be sized with sufficient dimension to decelerate the aggregated molecules to near-zero velocity before impacting the substrate 33.

This "soft landing" process brings the dopant atoms/molecules into physical contact with the process surface while leaving them with little kinetic energy, thus allowing them to efficiently bind to the surface of the substrate through physisorption or chemisorption. Helium-mediated soft landing, by virtue of the inert and non-destructive nature of helium, is amenable to use with any type of surface or thin film, including those of both inorganic materials (metals, semiconductors, and insulators) as well as organic materials. Exemplary surfaces or this films would be those used in the semiconductor processing industry and MEMS industry as well as those proposed for use in molecular electronics and biological sensor technologies. With provisions for cooling the substrate surface to a low operating temperature, even very non-reactive species can be made to physisorb. However, many dopant species can be expected to bind strongly at room temperature.

Helium is extremely inert and also has the lowest boiling point (4.2° K) of any atom or molecule. Accordingly, during deposition of the dopants, the helium carrier gas should not bind to the substrate surface at any temperature appreciably in excess of 4.2° K. Instead, He will return to its gas phase, which can then be evacuated out of the deposition chamber 14*c* by one or more vacuum pumps and can be collected, purified, and recycled if desired.

For dopant atoms or molecules that decorate the exterior surface of the helium droplets rather than aggregating at the center, a sacrificial layer of inert gas, such as argon, could be deposited on the substrate 33 to provide the soft or cushioned landing. The sacrificial layer may be deposited by lowering the substrate 33 to a sufficiently low temperature to facilitate absorption of the inert gas. Then by admitting a sufficient quantity of the inert gas to the deposition chamber, an adsorbed layer of a chosen thickness will develop. The remaining gas or excess gas may then be pumped out of the deposition chamber 14*c* and recycled if desired. The nanoscale printing can commence by activating the helium beam and carrying out the deposition process along the lines described above but with the deceleration mediated primarily by the adsorbed layer of inert gas on the substrate surface rather than the helium sheath of the impinging droplet. In the alternative embodiment that uses a layer of cushion of inert gas, the translational assembly 44 is preferably temperature controlled.

In one exemplary embodiment, the nozzle 14*a*, pickup 14*b*, and deposition 14*c* chambers are configured with appropriate vacuum pumping or educting capability to remove background or excess gases and maintain conditions of sufficiently low pressure that any residual gases remaining within those chambers do not adversely affect the deposition process, either through contamination or deflection of the loaded ink-jet droplets or through contamination or deterioration of the substrate or of the nanostructures deposited thereon. In one exemplary embodiment, a vacuum of about $10^{-8}$ atm or less is preferred, although other vacuum for other conditions, such as operating temperature, dopant species type, etc., may also be used. A number of commercially available vacuum pumps, vacuum control devices, and vacuum measuring devices are useable with the jet apparatus 10 of the present invention to produce, maintain, and quantify vacuum conditions. Exemplary devices include those used in the semiconductor processing industry.

In one exemplary embodiment, spent gases (i.e., gases not deposited onto the substrate) may be pumped from the vacuum chambers 14*a*, 14*b*, 14*c* and passed through a cold filter to purify the helium. This exhaust gas will contain species other than helium, e.g. molecules of the dopant species that were not captured by a passing helium droplet. Given the very low boiling point of helium, all species other than helium can be made to condense or solidify upon passage through a sufficiently cold filter. Subsequently, the helium may be further purified and re-liquefied by standard techniques.

Figure 2:
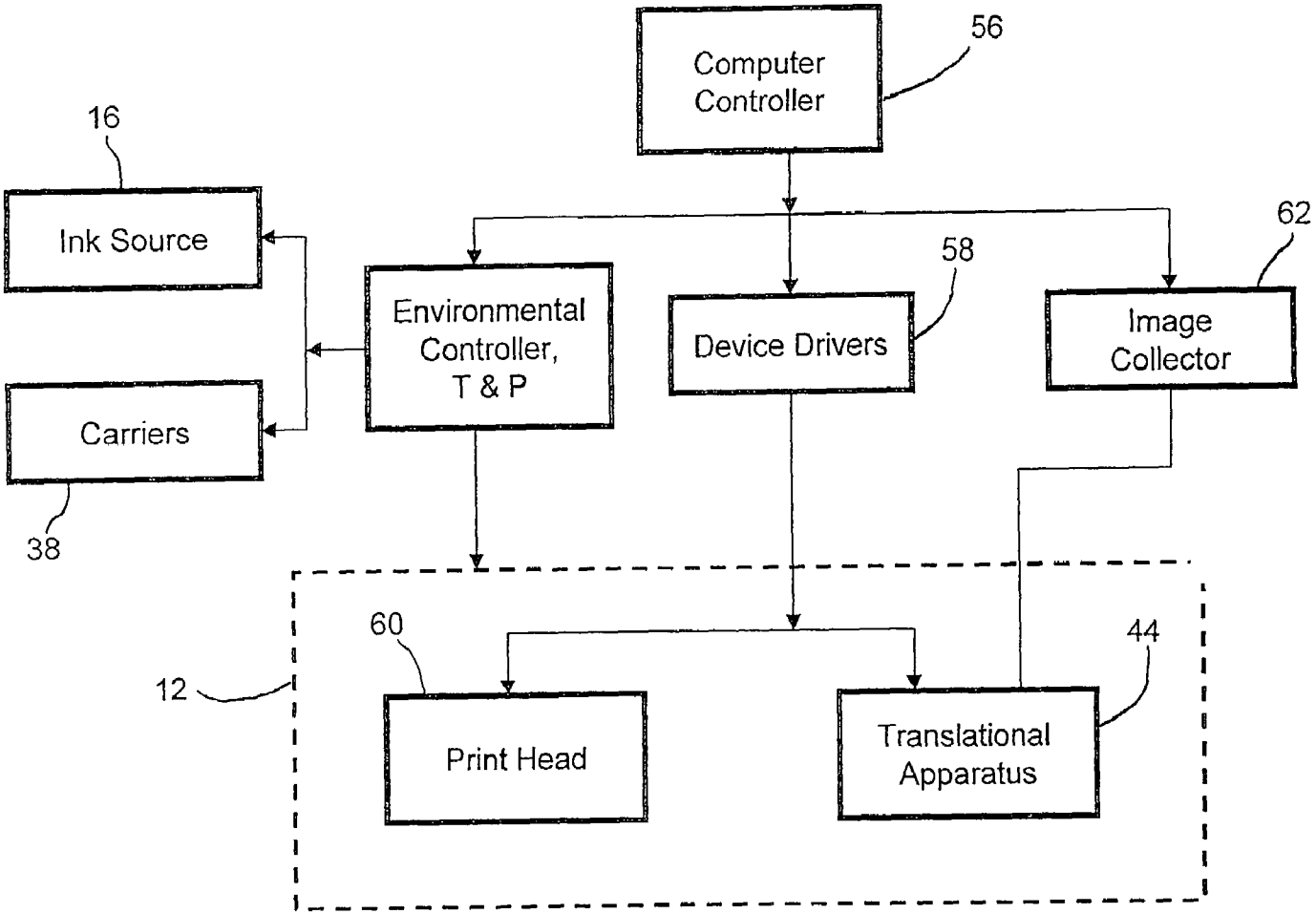
FIG. 2 is a block flow diagram of a control system of the jet apparatus of FIG. 1.

Turning now to FIG. 2, there is shown a semi-schematic block diagram 54 depicting an exemplary control system provided in accordance with aspects of the present invention. The block diagram 54 includes a computer controller 56 for controlling various the jet apparatus 10 functions. In one exemplary embodiment, the computer controller 56 may comprise a computer coupled to a plurality of device drivers 58. The device drivers 58 may include drivers for controlling the X-Y-Z directions of the translational assembly 44, for controlling the print head 60, which includes controlling the nozzle 20, the charging apparatus 30, and the other components implemented with the jet apparatus 10 for controlling the deposition of molecules onto the substrate 33. In addition, the one or more device drivers may be used to control the operating parameters of the cryogenic source 16 and the dopants. Other operating parameters include controlling the vacuum in the housing 12, the temperature of the translational assembly 44, and the position of the collimator or skimmer 42.

An image collector 62 may be included and controlled by the computer controller 56. The image collector 62 may include a video recorder or a camera or both for collecting footages and still images of patterns deposited on the substrate 33. The image collector 62 may include both manual and automatic mode for capturing images and footages. In one exemplary embodiment, images may be formed by directing electromagnetic waves, electrons, ions, or neutral atoms/molecules against the deposition surface.

An exemplary microscale ink-jet printer for depositing biologically active materials and the like is commercially available by MicroFab Technologies, Inc., Piano, Tex., under the trademark JETLAB®. The JETLAB® printer is available in both a continuous mode (similar to the mode described above) and a print on demand mode, similar to existing bubble jet or ink-jet printers. The present embodiments may be practiced by modifying the JETLAB® printer to operate as described above, namely to operate with superfluid helium as the ink diluent, to deposit dopants for pickup by helium droplets, and to deposit dopants onto a substrate through non-direct-contact printing technique.

Although the preferred embodiments of the invention have been described with some specificity, the description and drawings set forth herein are not intended to be delimiting, and persons of ordinary skill in the art will understand that various modifications may be made to the embodiments discussed herein without departing from the scope of the invention, and all such changes and modifications are intended to be encompassed within the appended claims. Various changes to the jet apparatus may be made including the use of nanoscale nozzle apertures formed by means other than ion milling or microcapillary pulling; variations in the size, shape, and construction of the apparatus chambers; the type and pumping speed of the vacuum pumps, gauges, and associated electronics; the method of cooling the helium liquid to its superfluid state; the type, number, means of activation, and control of devices used to inject dopant atoms/molecules into the path of the superfluid droplets; the use of molecular filters (e.g. electrophoresis) to supply the dopant injectors with a dopant species flow that varies in flow rate and/or species type and concentration as a function of time; the use of a pulsed liquid helium free-jet nozzle rather than a continuous flow nozzle; the orientation of the superfluid free-jet to be horizontal, vertical, or at any angle in between these extremes; the gravitational deceleration to lower or zero velocity of a vertically-oriented superfluid free-jet; the control of deposition by moving the nozzle relative to a stationary substrate rather than vice versa or by moving both; the scattering of the superfluid droplets from surfaces or neutral molecular beam optical elements (e.g. diffraction gratings) in order to manipulate the beam trajectory and/or the droplet characteristics; the use of neutral molecular beam optical elements to focus or defocus the superfluid beam; the deflection and manipulation of the superfluid droplets via momentum and/or energy transfer through impact with other molecular beams; and the reaction and/or combination of one or more dopant species within the superfluid droplets for the purpose of creating novel dopant species within the droplets prior to deposition. Accordingly, many alterations and modifications may be made by those having ordinary skill in the art without deviating from the spirit and scope of the invention.

What is claimed is:

1. A jet apparatus for nanoscale printing onto a substrate comprising a print head and a translational apparatus housed in a housing comprising at least one housing chamber; a reservoir comprising a cryogenic fluid in communication with the print head; and a dopant injector mechanically coupled to a storage containment comprising dopant molecules; and wherein at least one droplet of the cryogenic fluid is discharged from the print head and is expelled across at least a part of the housing chamber to combine with at least one dopant molecule discharged from the dopant injector, and wherein the combined at least one droplet of the cryogenic fluid and the at least one dopant molecule collides with the substrate positioned on the translational apparatus.

2. The jet apparatus of claim 1, further comprising an electrical-mechanical device; wherein the electrical-mechanical device induces an oscillation onto the print head.

3. The jet apparatus of claim 2, wherein the dopant-jet injector is synchronized with the cryogenic fluid by phase locking with the electrical-mechanical device.

4. The jet apparatus of claim 1, further comprising an exhaust line in communication with the housing chamber and a vacuum pump in communication with the exhaust line.

5. The jet apparatus of claim 4, wherein the vacuum pump maintains the housing at a pressure ranging from below $10^{-11}$ atm up to about 1 atm as dictated by the dopant molecules and the substrate.

6. The jet apparatus of claim 5, wherein excess cryogenic fluid and biologically active material are educted from the housing by way of the exhaust line and either recycled for reuse or discarded.

7. The jet apparatus of claim 1, further comprising a second dopant injector and a second storage containment comprising dopant molecules of a second type.

8. The jet apparatus of claim 1, further comprising a charging apparatus for charging the cryogenic fluid issuing from the print head and a deflection field for changing direction of the charged cryogenic fluid issuing from the print head.

9. The jet apparatus of claim 1, further comprising a micro-electro-mechanical systems (MEMS) deflector mounted inline with the print head for deflecting the cryogenic fluid issuing from the print head.

10. The jet apparatus of claim 1, further comprising a layer of inert gas formed on at least a portion of the substrate.

11. The jet apparatus of claim 1, wherein the cryogenic fluid forms a carrier droplet and wherein the at least one dopant molecule is absorbed into an interior of the carrier droplet or is adsorbed onto an exterior of the carrier droplet.

12. The jet apparatus of claim 1, further comprising an image collector pointed at the substrate for collecting still or moving images of the substrate.

13. The jet apparatus of claim 1, wherein the cryogenic fluid is superfluid helium.

14. The jet apparatus of claim 13, wherein the superfluid helium is either $^{3}$He or $^{4}$He.

15. The jet apparatus of claim 1, wherein the dopant molecules comprise a biologically active material.

16. The jet apparatus of claim 15, wherein the biologically active material comprises an ester, a carbohydrate, a lipid, a protein, a chromophore, a nucleotide, an RNA, a DNA, a purine, a porphyrin, an amino acid, a peptide, an antibody, a toxin, an antitoxin, a virus, a retrovirus, a vitamin, a vaccine, an enzyme, a chromosome, a gene, a bacterium or a microbe.

17. The jet apparatus of claim 1, wherein the reservoir is part of a cryostat and wherein the cryostat is cooled to below a superfluid transition temperature of $^3$He or $^4$He.

18. The jet apparatus of claim 1, further comprising a computer controller and device drivers for controlling the print head and the dopant-jet injector.

19. The jet apparatus of claim 1, wherein the print head comprises a nozzle comprising an orifice having a diameter of between about 1 nm to about 100,000 nm.

20. The jet apparatus of claim 1, further comprising a collimator mounted inline with a path of the cryogenic fluid.

21. The jet apparatus of claim 1, further comprising at least one stepper motor in mechanical communication with the translational apparatus.

22. A printer capable of non-contacting nanoscale printing comprising a print head comprising a nozzle having a nanoscale diameter orifice, a cryostat comprising a chamber comprising superfluid helium in fluid communication with the print head, a housing comprising at least one chamber comprising dopant molecules; and a translational apparatus comprising a substrate; wherein the superfluid helium issuing from the nozzle of the print head breaks up into nanoscale droplets; and wherein one or more nanoscale droplets of superfluid helium each picks up at least one dopant molecule and delivers the at least one dopant molecule into contact with the substrate.

23. The printer of claim 22, further comprising an electrical mechanical device in mechanical communication with the print head for imparting pressure oscillations onto the print head.

24. The printer of claim 22, further comprising a dopant-jet injector, a storage containment coupled to the dopant-jet injector, and dopant molecules contained within the storage containment; and wherein the dopant molecules in the at least one chamber are discharged from the dopant-jet injector.

25. The printer of claim 24, wherein the dopant-jet injector is synchronized with the superfluid helium issuing from the nozzle by phase locking with an electrical-mechanical device mounted to the print head.

26. The printer of claim 22, further comprising an exhaust line in communication with the at least one chamber and a vacuum pump in communication with the exhaust line.

27. The printer of claim 22, further comprising a charging apparatus for electrically charging the droplets issuing from the nozzle of the print head and a deflection field for changing the direction of the charged droplets.

28. The printer of claim 22, further comprising a micro-electro-mechanical systems (MEMS) deflector mounted inline with the print head for deflecting the superfluid helium issuing from the print head.

29. The printer of claim 22, further comprising a layer of inert gas formed on at least a portion of the substrate.

30. The printer of claim 22, wherein the at least one dopant molecule picked up by each of the one or more nanoscale droplets of superfluid helium aggregates at a center of each of the droplet or decorates an exterior surface of each of the droplets.

31. The printer of claim 22, further comprising a computer controller and device drivers for controlling the print head and the translational apparatus.

32. The printer of claim 22, wherein the nozzle comprises a diameter of between about 1 nm to about 100,000 nm.

33. The printer of claim 22, further comprising a second chamber and a third chamber, wherein the at least one chamber defines a source chamber, the second chamber defines a pickup chamber, and the third chamber defines a deposition chamber.

34. The printer of claim 22, wherein the superfluid helium is either $^3$He or $^4$He.

35. A method for non-contact printing onto a substrate comprising:

issuing a stream of superfluid helium from a nozzle along a path and allowing the stream to form into a plurality of nanoscale helium droplets;

placing dopants in the path of the plurality of nanoscale helium droplets and allowing at least some of the droplets to pick up some of the dopants placed in the path of the droplets; and depositing the picked up dopants by allowing the at least some of the droplets that picked up the dopants to collide with the substrate.

36. The method of claim 35, further comprising the step of moving the substrate relative to the nozzle.

37. The method of claim 35, further comprising the step of maintaining a vacuum during pickup and depositing steps.

38. The method of claim 35, further comprising the step of moving the nozzle relative to the substrate.

39. A jet apparatus for nanoscale printing onto a substrate comprising a housing comprising a nozzle having a nanoscale orifice, a chamber under a vacuum, a translational apparatus comprising a substrate, and a cryostat comprising a cryogenic source, wherein at least some of the cryogenic source issues from the nozzle and disperses into nanoscale droplets in the chamber, wherein at least some of the nanoscale droplets each comprises at least one dopant molecule picked up in the cryostat or picked up in the chamber, and wherein the picked up nanoscale droplets impact with the substrate.

* * * * *